US007188395B2

(12) United States Patent
Kondo et al.

(10) Patent No.: US 7,188,395 B2
(45) Date of Patent: Mar. 13, 2007

(54) SLIDE FASTENER

(75) Inventors: Naoki Kondo, Toyama-ken (JP); Yoneo Yoshida, Toyama-ken (JP); Yoshiyuki Toishi, Toyama-ken (JP); Hideji Maeda, Toyama-ken (JP)

(73) Assignee: YKK Corporation, Tokyo (JP)

( * ) Notice: Subject to any disclaimer, the term of this patent is extended or adjusted under 35 U.S.C. 154(b) by 145 days.

(21) Appl. No.: 10/686,594

(22) Filed: Oct. 17, 2003

(65) Prior Publication Data

US 2004/0078937 A1 Apr. 29, 2004

(30) Foreign Application Priority Data

Oct. 23, 2002 (JP) ..... 2002-308191

(51) Int. Cl.
*A44B 19/00* (2006.01)
*A44B 19/24* (2006.01)

(52) U.S. Cl. ..... 24/436; 24/387

(58) Field of Classification Search ..... 24/390, 24/391, 433, 436, 381, 416, 387–388
See application file for complete search history.

(56) References Cited

U.S. PATENT DOCUMENTS 2,112,725 A * 3/1938 Carlile ..... 24/388
2,193,827 A 3/1940 Marinsky
2,575,502 A 11/1951 Prupis
2,601,710 A 7/1952 Moehler
2,988,796 A 6/1961 Johns
3,964,137 A * 6/1976 Kihara ..... 24/401
4,752,992 A 6/1988 Kondo et al.
6,634,066 B2 * 10/2003 Okada et al. ..... 24/433
6,775,885 B1 * 8/2004 Wang ..... 24/385

FOREIGN PATENT DOCUMENTS

| | | |
|---|---|---|
| EP | 0 454 144 | 10/1991 |
| EP | 1 319 349 | 6/2003 |
| JP | 48-37421 | 11/1973 |
| JP | 49-36975 | 10/1974 |
| JP | 62-148116 | 9/1987 |
| JP | 5-31932 | 8/1993 |

* cited by examiner

*Primary Examiner*—Jack W. Lavinder
(74) *Attorney, Agent, or Firm*—Finnegan, Henderson, Farabow, Garrett & Dunner, L.L.P.

(57) ABSTRACT

A stopper portion has a minute protrusion on part of an outer peripheral face except a side face in the length direction of a fastener tape. This protrusion is a rib-like protrusion extended linearly in the length direction of the fastener tape formed on a vertex of the surface of a bent portion, a protrusion extended so as to be expanded in a curved shape in the length direction of the fastener tape or a rib-like protrusion protruded along a boundary portion between the bent portion of the stopper portion and a bottom face thereof. Existence of this protrusion not only reduces a sliding resistance when the slider is started but also eliminates prickly feeling and feeling of disharmony originating from a shape of an upper stopper which is a kind of the conventional stopper portion.

1 Claim, 3 Drawing Sheets

SLIDE FASTENER

BACKGROUND OF THE INVENTION

1. Field of the Invention

The present invention relates to a slide fastener in which a stopper portion is molded on a slide fastener tape by melting a resin stopper material having a U-shaped section with a pressure by ultrasonic heating, high-frequency heating or heating with a heater adjacent to fastener elements attached on a side edge of the fastener tape.

2. Description of the Related Art

Conventionally, as an upper stopper provided by melting resin material, generally, a film-like or monofilament-like material is attached on a top face of the fastener tape or fastener elements by welding means. For example in case of an upper stopper of a slide fastener disclosed in Japanese Patent Application Publication No. 48-37421, for example, monofilament made of thermoplastic synthetic resin such as polyester resin, or polyamide resin is cut out to a predetermined length and bent into a U shape and attached to an inverted portion or a leg portion of a coil-like fastener element by welding and pressing under a pressure. In case of an upper stopper of a slide fastener disclosed in Japanese Patent Application Publication No. 49-36975, a coil-like fastener element about as large as a bead formed on the side edge of a fastener tape is attached to the bead and then, a short filament material is placed on this fastener element, the bead and the top face of part of the fastener tape and these parts are melted and then solidified so as to mold the stopper portion.

However, because the upper stopper portions of these known slide fasteners are molded on only the top face of the fastener tape by welding, their mounting strength on the fastener tape is weak and the stopper portion which receives the largest impact when a slider flange strikes it is separated easily from the fastener tape, so that they do not endure a long-term usage. The top face of the slide fastener and its constituent members in this specification refers to an outside face of a product on which this slide fastener is mounted and its bottom face refers to its inside surface.

To aim at solving such a problem, conventionally, for example, Japanese Utility Model Application Laid-Open No. 62-148116 and Japanese Utility Model Application Publication No. 5-31932 have disclosed slide fasteners having the synthetic resin upper stopper which is never separated and ensures a large melting strength. According to these publications, those upper stoppers sandwich upper and lower faces of the side edge of a fastener tape and ends of the upper stopper on both the upper and lower surfaces on the tape main body are connected like a bridge through a gap or an opening between composition yarns of a woven or knit fabric so that they are welded integrally.

In any upper stopper molded in a flat ring shape of the slide fastener disclosed in the above respective publications, its surface is formed in a smooth flat plane. Thus, a contact area with an inner face of a slider is large and at the time of starting sliding of the slider so as to open the slide fastener, its sliding resistance is large so that a user cannot help feeling a heaviness. Further, not only the aforementioned flat shape of the upper stopper just increases the sliding resistance of the slider but also depends largely upon a separation resistance against biting of slider when slider's sliding is started.

Generally, closing of the slide fastener by sliding operation of the slider is attained by a contact between opposing end faces of right and left upper stoppers and the connecting post portion of the slider, and also by a contact between an end portion on the side of the tape main body of the upper stopper and the front face of the flange portion. Because when the upper stopper makes a contact with the slider, a quite large striking force is applied to the upper stopper due to the sliding operation of the slider, the slider may partially bite into the upper stopper. For the reason, the above-described fault occurs.

Generally, when the slide fastener is mounted on clothes, the bottom face of the same fastener is directed to the human body side and depending on a case, makes a direct contact with the skin. Thus, if such a minute protrusion is expanded from the bottom face of the fastener tape, it provides the skin with prickly feeling because it is a minute upper stopper. Further, when the slider is started, the upper stopper of the slide fastener is gripped with fingers of one hand while the pull tag is gripped with fingers of the other hand and operated. At this time, some people may feel disharmony because a hardness feeling of the upper stopper is transmitted to the fingers.

The prickly feeling and hardness feeling originate from a fact that the upper stopper is protruded outward from the surface of the fastener tape main body. From the above-mentioned patent publications 1 to 4, it is understood that any upper stopper is expanded outward from the surface of the fastener tape main body.

This invention has been achieved to solve these conventional problems and a specific object of the invention is to provide a slide fastener having a configuration which reduces a sliding resistance upon starting of its slider, originating from an upper stopper of the slide fastener, particularly an upper stopper formed by welding a U-shaped material of synthetic resin monofilament with heat under pressure and at the same time, eliminates prickly feeling and a feeling of disharmony originating from the shape of the upper stopper.

SUMMARY OF THE INVENTION

Part of the above-described object of this invention is a slide fastener in which a resin made stopper portion having a U-shaped section is fixed such that it is located adjacent to fastener elements, sandwiching a side edge of the fastener tape, which is a basic structure of the invention and the stopper portion is achieved by a slide fastener having a protrusion on part of an outer peripheral face of the fastener tape except its side face in the length direction. The protrusion can be secured by forming a dent portion for molding the protrusion in a corresponding portion of a mold for the stopper portion, or in a pressing surface of an ultrasonic horn or a high-frequency electrode or a placement surface of an opposing anvil or electrode, alternatively, in case of a heater, its heating surface.

Due to existence of the protrusion, when the sliding operation of the slider at the stopper portion is started in order to open the slide fastener, the same protrusion makes a contact with part of an inner face of the slider but the other surface of the stopper portion never makes a direct contact with a sliding face of the slider. Consequently, its sliding resistance is reduced largely thereby ensuring a smooth startup with a slight sliding operation. Further, because the existence of the protrusion presses the main body of the stopper portion to an opposite side of a side in which the stopper exists within the slider, a contact area between the flange portion of the slider and the stopper portion is increased at a final timing of the slider closing operation, that is, when the slider strikes the stopper portion, thereby preventing the slider form biting into the stopper portion. Consequently, the starting operation of the slider for opening the slide fastener is achieved lightly and smoothly.

Preferably, the protrusion is formed on the surface of the bent portion of the stopper portion. In this case, the protrusion may be formed at any position on the surface of the bent portion so as to be projected like a point. However, the same protrusion is preferably formed as a rib-like protrusion extended linearly in the length direction of a fastener tape at the vertex of the surface of the bent portion or on an outer end face of the surface of the bent portion so as to be expanded and extended in a curved shape in the length direction of the fastener tape. If the protrusion is formed at the vertex of the surface of the bent portion or an entire surface, not only the sliding resistance at the time of starting the operation of the slider is reduced, but also an end portion on the tape main body side of the stopper portion is shifted to the flange side within the slider. As a result, a contact area between the protrusion and the front face of the flange portion of the slider is increased, thereby decreasing the biting and at the same time, improving its sliding stop function.

The protrusion is preferred to be formed along the boundary portion between the bent portion of the stopper portion and the bottom face so as to be protruded. In this case, the protrusion is formed not on the surface of the bent portion but on a portion deflected to the side of its bottom face linearly along the length direction of the tape. Therefore, the stopper portion is pressed against the upper blade of the slider within the slider, so that the contact area with the front face of an element guide portion of an upper blade side flange of the slider is increased, thereby eliminating the biting of the slider into the stopper portion and improving the stop function.

Under this structure, according to the invention, preferably, the bottom face of the welded end portion on the side of the fastener tape main body of the stopper portion is located at least on the same level as the fastener tape main body or inside the bottom of the tape main body. If the welded end portion on the side of the fastener tape main body of the stopper portion is on the same level as the bottom of the fastener tape main body or the welded end portion of the stopper portion is dented, uncomfortable feeling and feeling of disharmony such as prickly feeling and feeling of hardness due to existence of the stopper portion are eliminated. When, for example, the end portion on the side of the tape main body of U-shaped bent stopper portion is heated with a pressure, such a structure can be obtained by restoration force of the tape main body by pressing the tape main body exposed to the surface with the end portion, adjacent to the end portion more strongly than the other pressing portion.

DESCRIPTION OF THE PREFERRED EMBODIMENTS

Hereinafter, typical embodiments of this invention will be described in detail with reference to the accompanying drawings.

Figure 1:
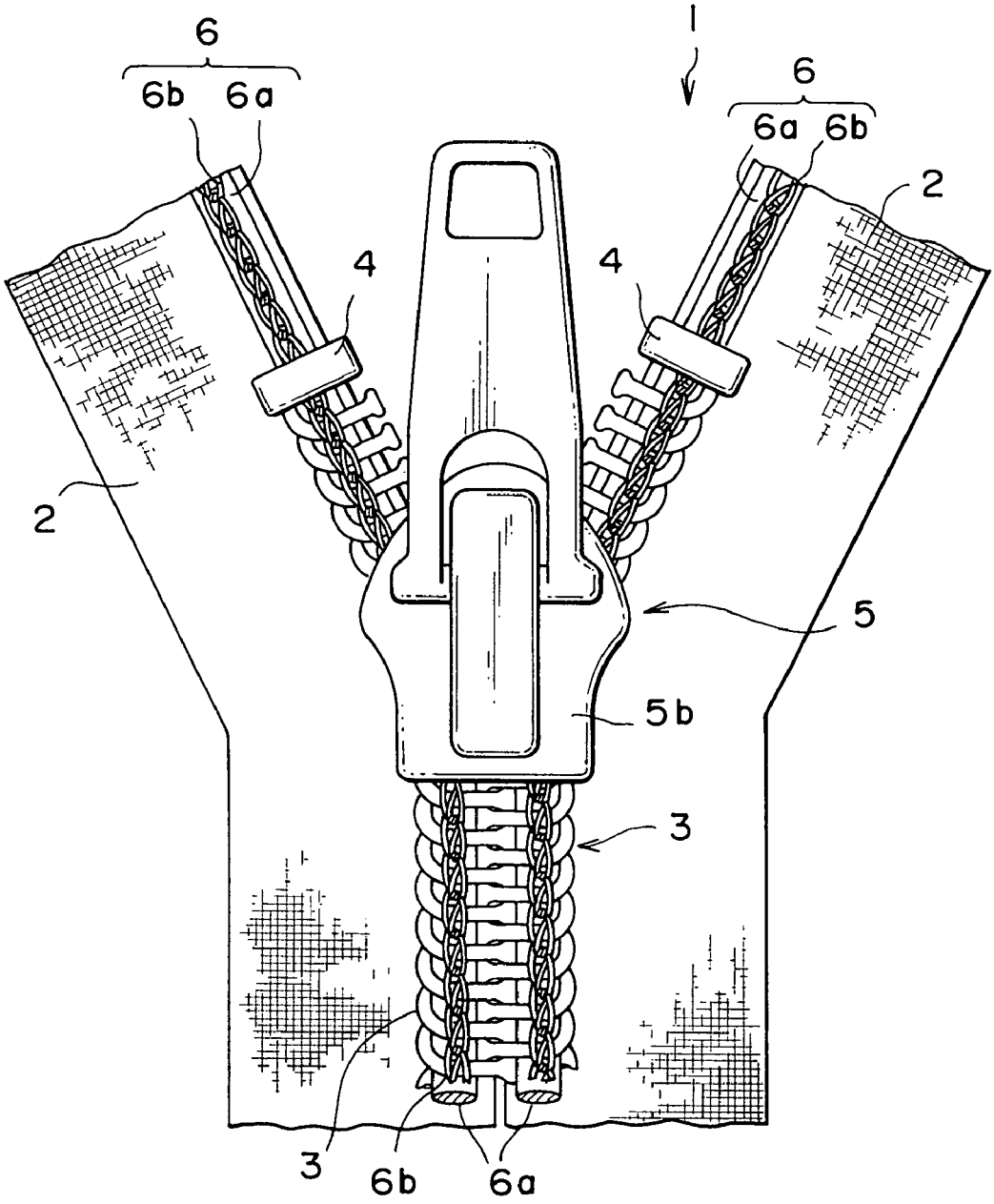
FIG. 1 is a partial top view showing the structure of a stopper attaching end portion of a slide fastener according to the invention.

FIG. 1 shows an end portion on the side of an upper stopper of a slide fastener according to the invention. As shown in FIG. 1, fastener elements 3 are attached to a side edge of a fastener tape 2. Usually, an upper stopper as a stopper portion 4 of the slide fastener 1 is mounted on an end portion on a closing side of a fastener chain while a lower stopper is mounted on an end portion on an opening side as the other stopper portion (not shown).

Like the stopper portions disclosed in the above-mentioned Japanese Utility Model Application Laid-Open No. 62-148116 and Japanese Utility Model Application Publication No. 5-31932, the stopper portion 4 as the aforementioned upper stopper comprises an upper leg portion 4*a* and a lower leg portion 4*b* which sandwich front and rear sides of the fastener tape, and a bent portion 4*c* which connects respective ends of the both leg portions 4*a*, 4*b*, and the stopper portion 4 is fixed and formed on each side edge of the fastener tape 2 having the fastener elements 3 attached thereon so as to cover the side edge of the fastener tape, with stopper material (not shown) having a U-shaped section produced from a thermoplastic synthetic resin monofilament or modified linear element of the same composition by ultrasonic heating or high-frequency heating or directly by heating with a heater (not shown) and then pressing from both front and rear sides of the fastener tape 2.

As the stopper material, for example, a flat monofilament formed from polyester resin or polyamide resin is cut out to a specific length and bent to have a U-shaped section. Corners of the monofilament are formed in a round shape. It is also permissible to cut out the modified linear element having the U-shaped section of the same composition to a predetermined width.

If the stopper portion 4 is formed integrally with the fastener tape 2 using the aforementioned stopper material, the stopper material formed in the U shape is placed adjacent to an end portion of the fastener elements attached on the side edge of the fastener tape 2, such that the front end of upper and lower leg portions of the stopper material projects to the side of a main body 2*a* of the fastener tape 2 from a connecting portion of the fastener elements 3. Additionally, a core portion existing on a side edge of the fastener tape 2 is sandwiched by the upper and lower leg portions and the stopper portion 4 is heated under a pressure so as to be formed at a specified position integrally with the fastener tape 2.

In case of ultrasonic processing, usually, a pressing face of a horn is set to oppose the bottom face of the tape and a top face of the tape is placed on a mounting face of an anvil. In case of high-frequency processing, any one of the tape top and bottom faces is set to oppose an electrode while an opposite face of the fastener tape 2 is placed on the other electrode face. In case of heating with a heater, the bottom face of the fastener tape 2 is placed on a lower heating face while its upper heating face is set to oppose the top face of the tape 2. Then, the stopper portion 4 is heated with a pressure together with a upper leg portion 4*a* and a lower leg portion 4*b* by the ultrasonic horn, the high-frequency electrode or heater (not shown) with a pressing face of each. Consequently, the stopper portion is welded with the fastener tape 2 and molded into a desired configuration.

According to this embodiment, like the above-mentioned patent publications 1 and 2, pressure upon the stopper portion 4 at an end portion thereof located on the tape main body 2*a* is intensified so as to penetrate part of molten resin into gaps generated between composition yarns of the fastener tape 2 and then, the upper and lower leg portions are joined together like a bridge. However, the invention covers an example in which the entire stopper material is pressed with the same pressure so that its inner faces are welded with the top and bottom faces of the fastener tape 2 instead of joining together part of the molten resin of the upper end portion and part of the molten resin of the lower end portion through the gaps between the composition yarns of the fastener tape 2 like a bridge, the upper and lower end portions being end portions of the stopper portion 4 on the side of the tape main body 2*a*.

In the slide fastener 1 manufactured in this way, if the slider 5 (see FIG. 3) is slid up to the stopper portion 4 in a direction of closing the same fastener 1, first, an outside end face of an inverted section 4*c*, which is a bent portion of the stopper portion 4, invades into a guide space of the slider 5 while making a sliding contact with a connecting post 5*a* of the same slider 5. Next, part of a rear section at an end of the tape main body 2*a* of the stopper portion 4 strikes a flange 5*b*-1 of an upper blade 5*b* of the slider 5 so as to block the slider 5 from escaping therefrom.

At this time, in case of the configuration of the conventional upper stopper, the flange 5*b*-1 may bite into the upper stopper in case where the sliding action of the slider 5 is violent because the striking area between the slider and the flange 5*b*-1 is small. If the flange 5*b*-1 bites into the upper stopper, this biting condition needs to be canceled when it is intended to move the slider 5 in an opening direction in order to open the slide fastener 1 and thus, a starting action of the slider 5 becomes heavy thereby obstructing a smooth startup.

Figure 2:
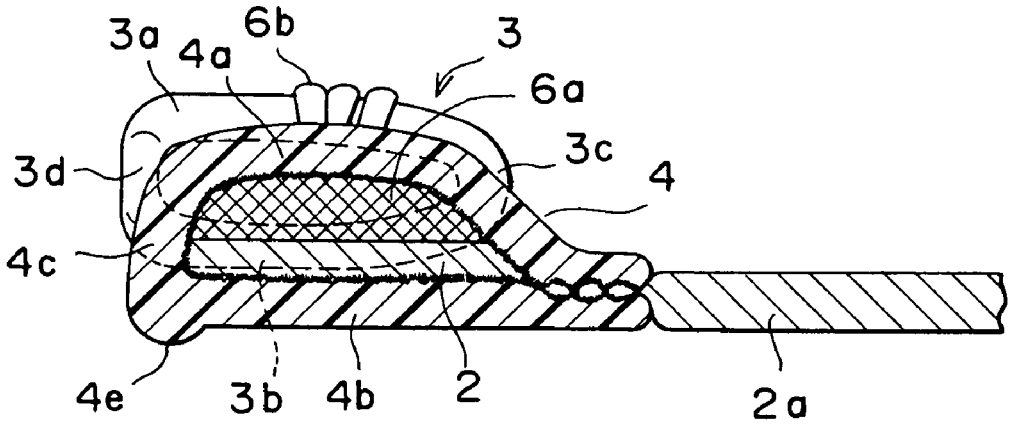
FIG. 2 is a partial sectional view showing a first embodiment at a stopper attaching portion of the slide fastener.

FIG. 2 shows sectional shape of the stopper portion 4 applied to the slide fastener 1 of this embodiment and its surrounding.

In the same figure, a cross-hatched section of the loop-like stopper portion 4 indicates a core portion 6 comprised of a core thread 6*a* inserted into a space formed by the upper and lower leg portions 3*a*, 3*b* of the coil-like fastener elements 3, the connecting portion 3*c* and a coupling head 3*d*, and sewing threads 6*b* used for fixing the elements 3 onto the fastener tape. This section is left after the fastener element 3 is removed. Although according to this embodiment, the stopper portion 4 is formed adjacent to a cut end portion of the element 3, the end section of the fastener element 3 is often sandwiched by the stopper material together with the core portion 6 when the core portion 6 is held by the U-shaped same material.

A prominent feature of this invention exists in the shape of the stopper portion 4*e*, particularly in that a protrusion 4 projecting outward from the vicinity of its bent portion is formed. In the indicated embodiment, the protrusion 4*e* is projected downward from a bent corner of the lower leg portion 4*b* so that a linear rib extending in the length direction of the tape (perpendicular to this paper in FIG. 2) is formed. To mold this rib-like protrusion 4*e*, for example, in case of molding the stopper portion 4 by high-frequency heating, a molding cavity for the protrusion 4*e* is formed in the electrode face on the side in which the fastener tape 2 is to be placed. A bottom face of the stopper portion 4 except the protrusion 4*e* of the lower leg portion 4*b* of this embodiment is a flat plane on a substantially same level as a bottom face of the fastener tape main body 2*a* and a top face of the upper leg portion 4*a* is curved upward. Then, this stopper portion is welded integrally with the tape main body 2*a* such that an end portion thereof on the tape main body side melts, and is connected with an end portion of the lower leg portion 4*b* on the tape main body side through the tape main body 2*a*.

Figure 3:
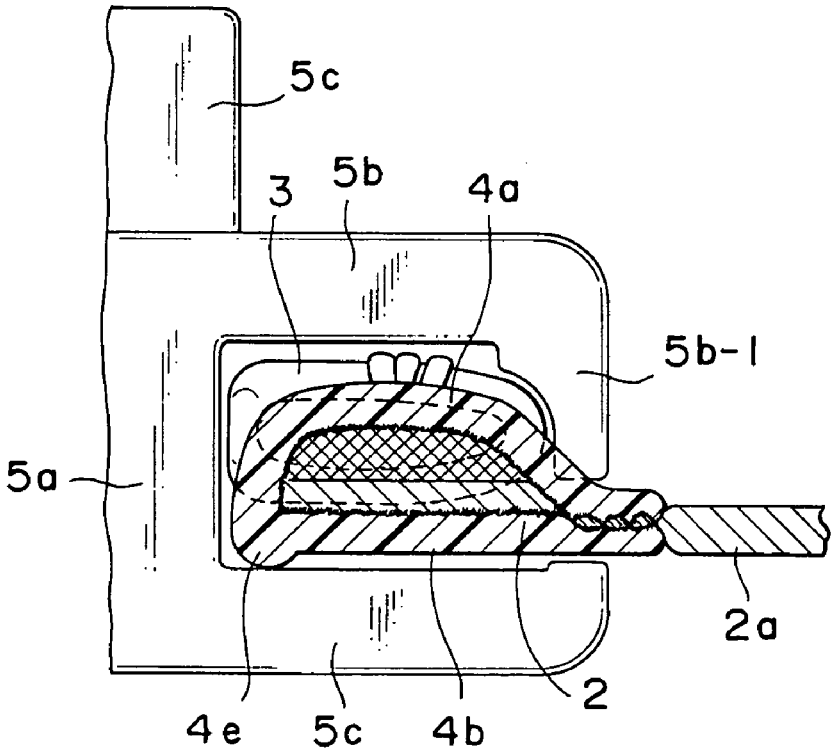
FIG. 3 is a sectional view of major parts indicating the positional relation between the stopper attaching portion and the slider.

According to this embodiment, due to the provision of the above-described upper stopper structure, when it is intended to close the slide fastener 1 by sliding the slider 5, the slider 5 arrives at the stopper portion 4, so that a side face of the connecting post 5*a* of the slider 5 comes into a sliding contact with an outside end face of the inverted portion 4*c* of the bent portion of the stopper portion 4 while the flange 5*b*-1 of the upper blade 5*b* strikes a rear end face of the upper leg portion 4*a* of the stopper portion 4, thereby stopping a further sliding movement. FIG. 3 shows a striking area when the flange 5*b*-1 of the upper blade 5*b* strikes the rear end face of the upper leg portion 4*a* of the stopper portion 4 with dotted line.

Although the striking area at this time is small, a sufficient stop function against the slider 5 is secured and this area is larger than that of the conventional example. Its reason exists in the protrusion 4*e* which is the feature of the invention. According to the embodiment, as shown in FIG. 3, the stopper portion 4 has partially invaded in the inside of the slider 5 and an existence of the protrusion 4*e* makes the lower leg portion 4*b* of the stopper portion 4 float above a guide plane of the lower blade 5*c* of the slider 5. Due to an influence of this floating, the upper leg portion 4*a* of the end portion on the tape main body side of the stopper portion 4 is also lifted upward, so that the aforementioned striking area is secured. Unless the protrusion 4*e* exists, it comes that the entire bottom of the end portion on the tape main body side of the lower leg portion 4*b* comes into contact with the guide plane of the lower blade 5*c*, so that the entire stopper portion 4 is located downward by the corresponding amount, thereby the striking area being reduced.

The existence of the protrusion 4*e* according to this embodiment reduces a starting force required to open the slide fastener 1, and enables the starting operation to be executed with a light force. That is, because the striking area is increased, a possibility of such an event that the flange 5*b*-1 of the slider 5 disengages from the rear end face of the upper leg portion 4*a* of the stopper portion 4 thereby biting into the stopper portion 4 is eliminated and consequently, the starting operation of the slider 5 can be executed smoothly. At the same time, because the existence of the protrusion 4*e* reduces a contact area between the bottom face of the lower leg portion 4*b* of the stopper portion 4 and the lower blade 5*c* of the slider 5, sliding resistance which occurs when starting the slider is decreased, thereby smoothing the starting operation of the slider 5.

According to this embodiment, as shown in FIG. 2, part of molten resin of a welded end portion on the side of the tape main body 2*a* of the stopper portion 4 invades into gaps between, for example, warp or weft yarns constituting the tape main body 2*a*, so that both end portions are connected like a bridge. As in the above publications 3 and 4, the welding strength is high, and further, according to this embodiment, thickness in vertical direction of the welded end portion on the side of the tape main body 2*a* of the stopper portion 4 is adjusted to substantially the same as the vertical thickness of the tape main body 2*a* projected to the side of the main body. If the bottom face of an end portion of the stopper portion 4 is pressed with the bottom face of the main body 2*a* of the tape 2, for example when the bottom face of the stopper portion 4 is pressed by heating for formation, the tape main body 2*a* compressed at the time of the pressing is restored to its original thickness. As a result, the bottom face of the welded end portion of the stopper portion 4 and the bottom face of the tape main body 2*a* extended horizontally therefrom are included in a substantially same plane.

Generally when opening/closing the slide fastener, particularly releasing the slide fastener, with a fastener attaching portion of the stopper portion gripped with fingers of a hand, a pull tab (not shown) of the slider 5 is gripped with fingers of another hand and the slider is operated. If an end portion of the stopper portion 4, particularly, on the tape main body side of the bottom surface is projected outward from the bottom face of the tape main body 2*a*, the projecting portion touches the finger so that a local strictness is felt as compared with a surrounding plasticity, thereby providing a feeling of disharmony. Because the lower leg portion 4*b* of the stopper portion 4 opposes the skin directly, if the bottom surface of this portion is projected outward from the tape main body 2*a*, an irritation feeling is caused by that bottom face, so that a wearer may feel a discomfort. In this point, according to this embodiment, because the bottom face of the stopper portion 4 is not projected from the tape main body 2*a*, a possibility of the aforementioned feeling of disharmony and discomfort is eliminated.

Figure 4:
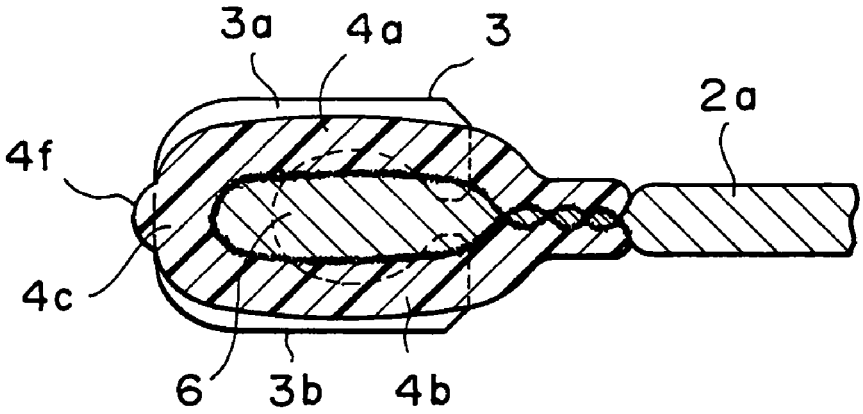
FIG. 4 is a partial sectional view showing a second embodiment at the stopper attaching portion of the slide fastener.

FIG. 4 shows a second embodiment which is a typical example of the invention. This embodiment concerns a slide fastener in which metallic fastener elements are attached individually along a side edge of the fastener tape 2. A side edge portion of the fastener tape 2 is nipped between a pair of the leg portions 3*a* and 3*b* of each fastener element 3 and by crimping the leg portions 3*a*, 3*b* inwardly, the fastener elements 3 are implanted on the side edge portion of the fastener tape 2.

In this kind of the slide fastener 1, the upper and lower leg portions 3*a*, 3*b* of the fastener element 3 are symmetrical to each other. Thus, the slider 5 and the flanges 5*b*-1, 5*c*-1 of the upper and lower blades 5*b*, 5*c* are vertically symmetrical to each other. A protrusion 4*f* of this embodiment is formed on a vertex of the bent portion of the stopper portion 4. Like the above-described first embodiment, this protrusion 4*f* is formed in the form of a rib extended linearly in the length direction of the fastener tape 2. In case where, for example, the stopper portion 4 is molded integrally in the fastener tape 2 by heating with a heater, the protrusion 4*f* is molded by providing the vertex of the bent portion of upper and lower heater surfaces with a cavity for molding the protrusion.

When the slide fastener 1 is about to be closed by sliding the slider 5 in the slide fastener provided with the stopper portion 4 of this embodiment, the slider 5 reaches the stopper portion 4 and side faces of the connecting post 5*a* of the slider 5 moves with a sliding contact with the vertex of the bent portion of the stopper portion 4. Because at this time, the protrusion 4*f* is projected from the vertex portion, it pushes right and left stopper portions 4 in an opening direction. As a result, contact area at the time when the front faces of the respective flanges 5*b*-1, 5*c*-1 of the upper and lower blades 5*b*, 5*c* strike the upper and lower leg portions 4*a*, 4*b* of the stopper portion 4 increases, thereby stopping the sliding of the slider 5 securely.

Also in this embodiment, the existence of the protrusion 4*f* reduces a starting force for opening the slide fastener 1 and enables the starting operation at this time to be carried out with a slight force. That is, because the striking area is increased, a possibility of such an event that the upper and lower flanges 5*b*-1, 5*c*-1 of the slider 5 may slip out of rear end faces of the upper and lower leg portions 4*a*, 4*b* of the stopper portion 4 and bite into a fastener tape is eliminated and consequently, the stop operation and starting operation of the slider 5 can be carried out smoothly. Further, because the existence of the protrusion 4*e* reduces a contact area between the stopper portion 4 and the connecting post portion 5*a* of the slider 5, when the slider is started, its sliding resistance is reduced thereby smoothing the starting operation of the slider 5.

Figure 5:
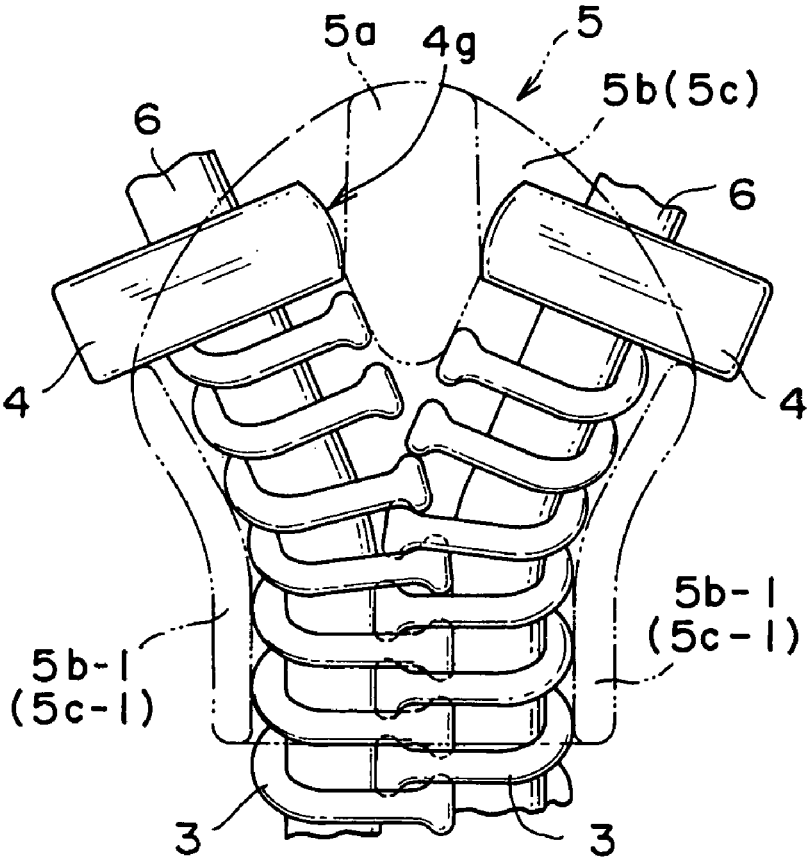
FIG. 5 is a top view of major parts indicating a third embodiment at the stopper attaching portion of the slide fastener.

FIG. 5 shows a third embodiment of the slide fastener of the invention. According to this embodiment, instead of the rib-like protrusion 4*f* of the second embodiment, an entire outside surface of the bent portion of the stopper portion 4 is curved so as to expand outward in the length direction of the fastener tape 2 so that an expanded portion 4*g* is formed. According to this embodiment, the entire expanded portion 4*g* corresponds to the protrusion of the invention. The other configuration of the slide fastener 1 is similar to those of the first and second embodiments. For the reason, the same reference numerals as the first and second embodiments are used except the expanded portion 4*g*.

Also in the third embodiment, like the second embodiment, when a user tries to close the slide fastener 1 by sliding the slider 5, the slider 5 arrives at the stopper portion 4 and the side face of the connecting post portion 5*a* of the slider 5 makes a sliding contact with the expanded portion 4*g* formed on the bent portion of the stopper portion 4 when the slider is slid. At this time, like the second embodiment, the curved face of the expanded portion 4*g* presses out the right and left stopper portions 4 in a direction of opening the stopper portion. Consequently, a contact area when the front face of the flange 5*b*-1 of the upper blade 5*b* strikes the rear end face of the upper leg portion 4*a* of the stopper portion 4 increases, thereby stopping the sliding of the slider 5 securely.

According to this embodiment, existence of the protrusion 4*f* reduces the starting force when a user tries to open the slide fastener 1 and allows the starting operation to be carried out with a light force. That is, because the striking area is increased, like the second embodiment, the upper flange 5*b*-1 on the slider 5 never escapes from the end face on the rear mouth side of the upper leg portion 4*a* of the stopper portion 4 nor bites into the stopper portion. Further, because the expanded portion 4*g* of the stopper portion 4 only makes a point-like or linear contact with the connecting post 5*a* of the slider 5, the contact area between the stopper portion 4 and the connecting post 5*a* of the slider 5 is decreased. Therefore, when a user starts the operation of the slider, its sliding resistance is decreased and additionally, the starting operation of the slider 5 is smoothed.

The formation positions of the protrusion 4*e* and 4*f* according to the first embodiment and the second embodiment are not limited to the above-described embodiments and instead of the protrusion 4*e* on the stopper portion 4 in the first embodiment, the protrusion 4*e* may be formed on the vertex of the bent portion of the stopper portion 4 like the protrusion 4*f* in the second embodiment and vice versa. Although the protrusions 4*e*, 4*f* are formed in a rim shape, it is permissible to form a plurality of point-like protrusions or to form an entirely curved expanded portion 4*g* like the third embodiment. The formation position and shape of the stopper portion of the slide fastener of the invention may be modified in various ways and the invention is not restricted to the above-described embodiments.

What is claimed is:

1. A slide fastener comprising:

a resin stopper portion provided adjacent to an end portion of fastener elements and welded to a fastener tape, the stopper portion comprising an upper leg portion and a lower leg portion which sandwich a side edge of the fastener tape from above and below, and a bent portion which connects respective ends of the upper and lower leg portions, wherein the stopper portion is integrally molded with a protrusion by molding the protrusion protruding from one part of an outer peripheral face thereof, and wherein the protrusion is a rib-like protrusion protruded along a boundary between the bent portion of the stopper portion and a bottom face thereof.

* * * * *